US007348869B2

(12) United States Patent
Jakob

(10) Patent No.: US 7,348,869 B2
(45) Date of Patent: Mar. 25, 2008

(54) ADJUSTABLE COAXIAL FILTER DEVICE WITH AXIALLY ADJUSTABLE INNER CONDUCTOR

(75) Inventor: Friedrich Jakob, München (DE)

(73) Assignee: Spinner GmbH (DE)

( * ) Notice: Subject to any disclaimer, the term of this patent is extended or adjusted under 35 U.S.C. 154(b) by 150 days.

(21) Appl. No.: 11/346,595

(22) Filed: Feb. 3, 2006

(65) Prior Publication Data

US 2006/0170522 A1 Aug. 3, 2006

(30) Foreign Application Priority Data

Feb. 3, 2005 (DE) ..... 10 2005 005 088

(51) Int. Cl.
*H01P 1/202* (2006.01)

(52) U.S. Cl. ..... 333/207; 333/263

(58) Field of Classification Search ..... 333/206, 333/207, 263

See application file for complete search history.

(56) References Cited

U.S. PATENT DOCUMENTS 2,577,511 A * 12/1951 Cohn ..... 333/207
3,393,384 A * 7/1968 Bailey et al. ..... 333/206
3,939,443 A * 2/1976 Biro et al. ..... 333/202
4,303,899 A * 12/1981 Barley et al. ..... 333/225
4,616,195 A 10/1986 Ward et al.

FOREIGN PATENT DOCUMENTS

| | | |
|---|---|---|
| DE | 911 627 C | 5/1954 |
| DE | 1 062 485 | 1/1958 |
| DE | 199 07 413 | 8/2000 |

* cited by examiner

*Primary Examiner*—Benny Lee
(74) *Attorney, Agent, or Firm*—Edell, Shapiro & Finnan, LLC

(57) ABSTRACT

An adjustable filter includes an outer conductor, a first inner conductor, and a second inner conductor. The inner conductors are capacitively coupled on the same axis. The further may further include a third inner conductor capacitively coupled to both the first and second inner conductor. The third inner conductor is axially displaceable with respect to the first and second inner conductors. With this configuration, generation of intermodulation products can be minimized.

5 Claims, 4 Drawing Sheets

ADJUSTABLE COAXIAL FILTER DEVICE WITH AXIALLY ADJUSTABLE INNER CONDUCTOR

CROSS REFERENCE TO RELATED APPLICATIONS

This application claims priority under 35 U.S.C. § 119 to DE 10 2005 005 088.3, filed on Feb. 3, 2005 and titled "A Coaxial Adjustable Filter," the entire contents of which are hereby incorporated by reference in its entirety.

FIELD OF THE INVENTION

The invention relates to an adjustable filter and, in particular, to filter with at least one stage comprising an outer conductor, a first inner conductor, and a second inner conductor coupled in a capacitive manner on the same axis to the second inner conductor.

BACKGROUND OF THE INVENTION

The coils and capacitors used in filters with frequencies above a few hundred MHz can be reproduced by line sections having suitable length and designated impedances. While the inductances of the designated value can be realized relatively easily by short line sections with high impedances, in production, it is virtually impossible to accurately maintain capacitance values of a few pF using inner conductors coupled in a capacitive manner. The tolerances of the produced capacitance values adversely influence the frequency response. This phenomenon is illustrated graphically in FIG. 2, showing a plot of reflection vs. frequency for the circuit diagrammed FIG. 1. Specifically, Curve 1 shows the frequency-dependent curve of the reflection factor for the setpoint values of the inductances and the capacitances. Curve 2 shows the progress of the reflection factor at a deviation of the capacitance values by 10% from the setpoint value. As a result of this difficulty, multiple-circuit filters are usually produced in stripline technique and with adjustable trimming capacitors. Respective junctions are necessary at the input and output for insertion into coaxial antenna feeder cables.

Conventional single-stage filters include a first inner conductor coaxially disposed with respect to a second inner conductor. The opposite surfaces of the first and second inner conductors are dimensioned such that a series capacitance having a set value is formed (optionally in conjunction with a dielectric other than air). If the capacitance value needs to be adjustable, one of the inner conductors must be adapted to telescope so that it can be displaced with respect to the other inner conductor. Typically, the displaceable part of this inner conductor contacts its fixed part in a conductive manner, e.g., using spring segments. Such a configuration produces intermodulation products at the contact points. These products are undesirable, especially in technologies such as cellular radio, which requires a high signal-to-intermodulation ratio.

OBJECTS AND SUMMARY OF THE INVENTION

An object of the invention is to provide an coaxial filter that is simple to produce, and adjusts in such a way that intermodulation products are minimized.

This object is achieved in accordance with the invention by capacitively coupling a third inner conductor with both the first and second inner conductors such that is the third conductor is axially displaceable.

The filter thus has adjustable series capacitances in coaxial technique, but makes do without any electrically conductive contacts and thus prevents the formation of intermodulation products.

In one embodiment, the filter comprises a first inner conductor and a second inner conductor, wherein the conductors are enclosed in their capacitive coupling region by a sleeve comprising insulating material. A third inner conductor is further configured as a metal sleeve that is axially displaceable on the insulating sleeve.

The first and the second inner conductors may also be configured for telescopic engagement in the region of their capacitive coupling, while remaining isolated from each other. The telescopically engaging regions of the first and second inner conductors can be separated from one another by the insulating sleeve. This comes with the advantage that by choosing an insulating material with a suitable relative dielectric constant it is possible to have an influence on the overall length.

In another embodiment, the first inner conductor and the second inner conductor are provided with a tubular configuration at least in the region of their capacitive coupling and enclose a common insulating sleeve in which the third inner conductor is axially displaceable, e.g., by means of a longitudinal slot in the first and/or second inside conductor and the insulating sleeve.

In addition, the first and the second inner conductor can be axially displaceable relative to one another.

The adjustment can be performed, for example, by making the outer conductor (with a circular or polygonal internal cross section) divisible in the longitudinal direction or equipping the outer conductor with a removable cover. Alternatively, the outer conductor can also be provided at the adjustment points with a sealable opening. Once the desired adjustment is made, the position of the third inner conductor can be fixed with any desired HF-compatible means, e.g., by gluing or by PTFE rings.

It has been observed that in series production, it is sufficient to perform the adjustment on a sample item of the filter and to transfer the set position of the inner conductors to the other filters of the same series without performing an electric adjustment again.

DETAILED DESCRIPTION

Figure 1:
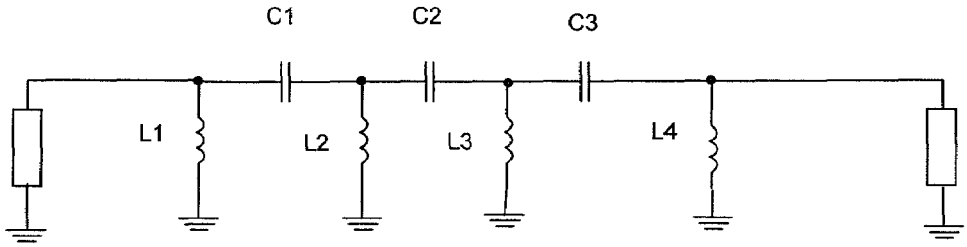
Fig. 1 (Prior Art)
FIG. 1 illustrates a block diagram of a series circuit of a conventional filter, showing the resulting series capacitances.
Figure 2:
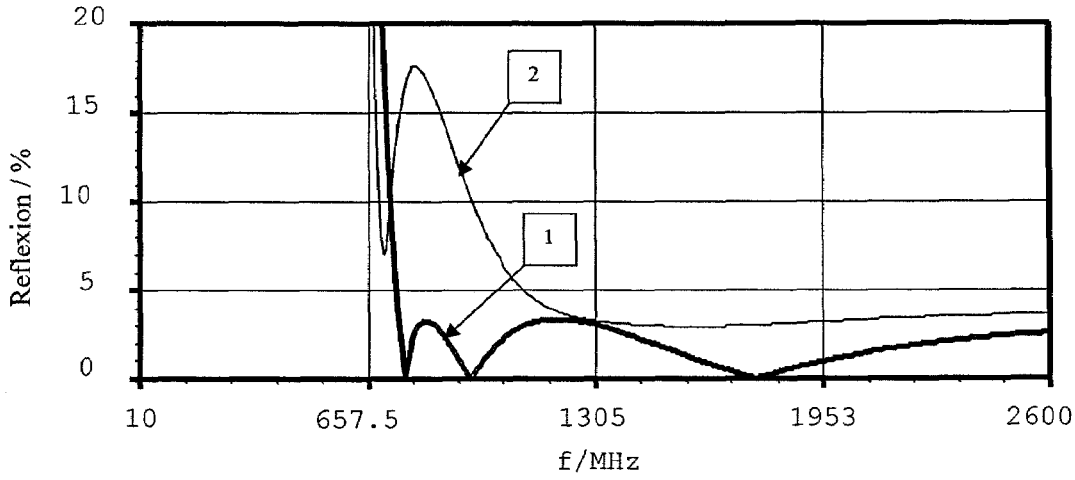
Fig.2 (Prior Art)
FIG. 2 illustrates a graph relating to the circuit of FIG. 1.
Figure 3:
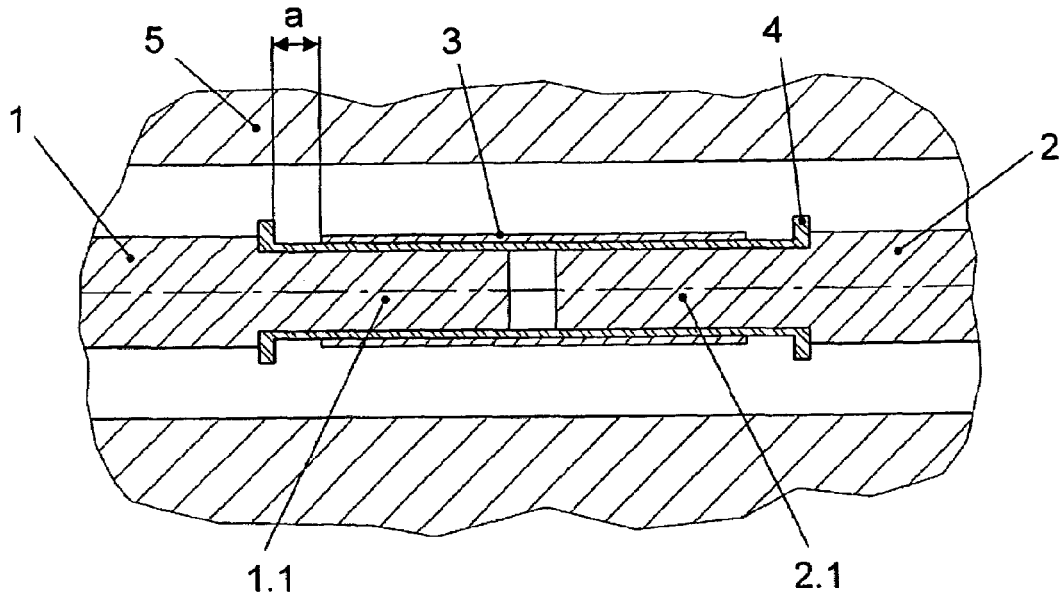
FIG. 3 illustrates a cross sectional view of an adjustable filter device according to an embodiment of the invention.

FIG. 3 illustrates a cross sectional view of an adjustable filter according to an embodiment of the invention. As shown, a first inner conductor 1 and a second inner conductor 2 are partially disposed within an outer conductor 5 (also shown in FIG. 7). The inner conductors 1, 2 are spaced apart—the first inner conductor 1 is set a predetermined distance away from the second inner conductor 2. An insulating sleeve 4 covers a section 1.1 of the first inner conductor 1 and a section 2.1 of the second inner conductor 2, bridging the opening that results from the spaced positioning. The diameter of the first section 1.1 is reduced with respect to the remainder of first inner conductor 1. Similarly, the diameter of the second section 2.1 is reduced with respect the remainder of the second inner conductor 2. In other words, the inner conductors 1 and 2 have sections 1.1 and 2.1 with a reduced diameter. The length of the inner conductors 1, 2 and/or the sections 1.1, 2.1 can be determined mathematically.

The insulating sleeve 4 is enclosed by a third inner conductor 3. The third inner conductor 3 may be generally tubular or hollow, and is axially displaceable with respect to the first and second conductors 1, 2 (i.e., in the direction of the first inner conductor 1 or the second inner conductor 2). For example, as shown in FIG. 3, the third conductor 3 is axially displacable along a path by a distance a. The material comprising the third inner conductor 3 includes, but is not limited to, metal (e.g., a metal sleeve). With this configuration, the first inner conductor 1 and the second inner conductor 2, including their sections 1.1 and 2.1 and the third inner conductor 3, act in conjunction with the outer conductor 5 as inductances whose values can be calculated from their respective diameters and lengths. By way of example, their inductance values may be calculated using commercially available software (e.g., software available from APLAC Corp., Espoo, Finland (www.aplac.com)).

Figure 4A:
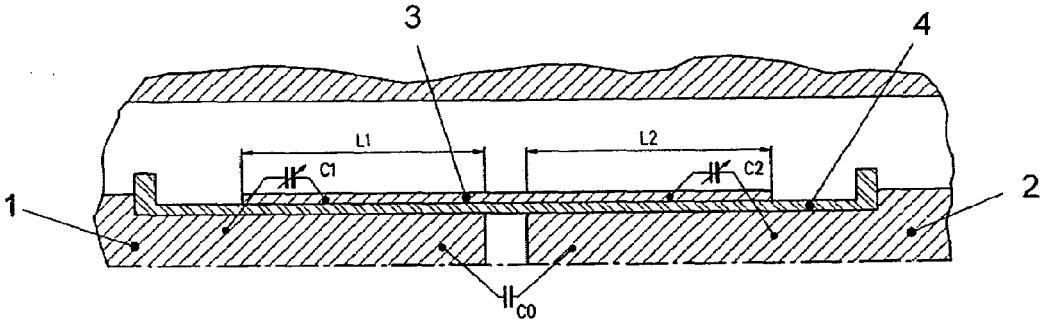
FIG. 4A illustrates the filter device of FIG. 3, showing series capacitances.
Figure 4B:
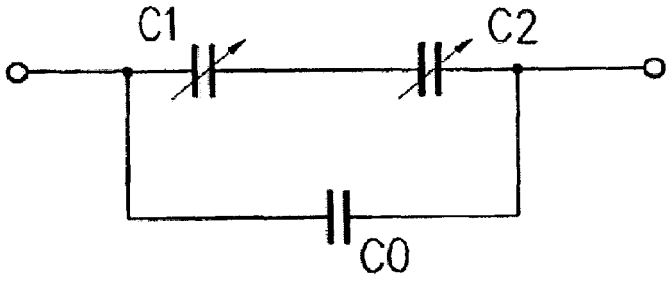
FIG. 4B illustrates the circuit block diagram of the adjustable filter device of FIG. 3, showing series capacitances.

FIG. 4A illustrates the series capacitances existing between the isolated inner conductors 1, 2, 3, across insulating sleeve 4, while FIG. 4B illustrates the related circuit block diagram (where, as shown, $C_1$ is the capacitance between first inner conductor 1 and third inner conductor 3. $C_2$ is the capacitance between the second inner conductor 2 and the third inner conductor 3, and $C_0$ is the capacitance between first inner conductor 1 and the second inner conductor 2). By neglecting the fringing capacitances, the respective capacitance values are obtained from the known formula:

$$C = \varepsilon_0 \cdot \varepsilon_r \cdot \left(\frac{A}{d}\right) \tag{1}$$

wherein C means the capacitance value, A the surface area, d the distance, $\epsilon^0$ the absolute dielectric constant and $\epsilon_r$ the relative dielectric constant. The value of the total series capacitance $C_{ges}$ is then $$C_{ges} = C_0 + \frac{C_1 \cdot C_2}{C_1 + C_2} \tag{2}$$

Thus, the total series capacitance $C_{ges}$ is dependent on the position of the third inner conductor 3 relative to the first inner conductor 1 and the second inner conductor 2, because the surface area A in Formula 1 is proportional to L1 or L2 (FIG. 4A). (where, as shown, L1 is the length of overlap between the third inner conductor 3 and the first inner conductor 1, and L2 is the length of overlap between the third inner conductor 3 and the second inner conductor 2). It also follows from this that the series connection of C1 and C2 has its maximum capacitance value when L1=L2.

Figure 5:
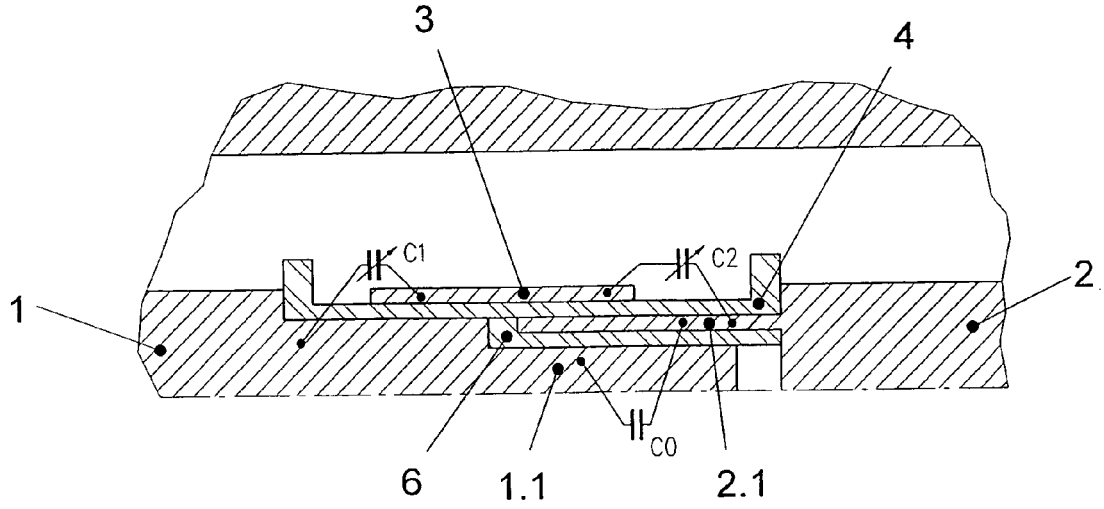
FIG. 5 shows a cross sectional view of an adjustable filter device according to another embodiment of the invention.

FIG. 5 shows another embodiment of the invention. Specifically, the embodiment according to FIGS. 3 and 4 has been modified such that the section 1.1 of the first inner conductor 1 and the section 2.1 of the second inner conductor 2 are no longer opposite each other at a predetermined distance, but engage into each other telescopically. That is, the inner conductors 1, 2 no longer face each other such that they are spaced from each other at a predetermined distance, but are now configured such that the sections 1.1, 2.1 engage into each other telescopically. (i.e., the first inner conductor 1 and the second inner conductor 2 are axially displacable relative to one another). A sleeve 6 made of an insulating material is arranged between the section 1.1 of the first inner conductor 1 and the second section 2.1 of the inner conductor 2. As such, the value of C0 can be influenced by not only the immersion depth of the first inner conductor section 1.1, but also by the thickness and the material of the insulating sleeve 6. The fine adjustment is made as in the case of the embodiment shown in FIG. 3, namely by displacing the third inner conductor 3. (i.e., the capacitances of $C_1$ and $C_2$ are adjusted as the third conductor is axially displaced). As shown in FIG. 5 $C_1$ is the capacitance between the first inner conductor 1 and the third inner conductor 3, across insulating sleeve 4, $C_2$ is the capacitance between the section 2.1 of the second inner conductor 2 and the third inner conductor 3, across insulating sleeve 4, and $C_0$ is the capacitance between the section 1.1 of the first inner conductor 1 and the second 2.1 of the second inner conductor 2, across sleeve 6.

Figure 6:
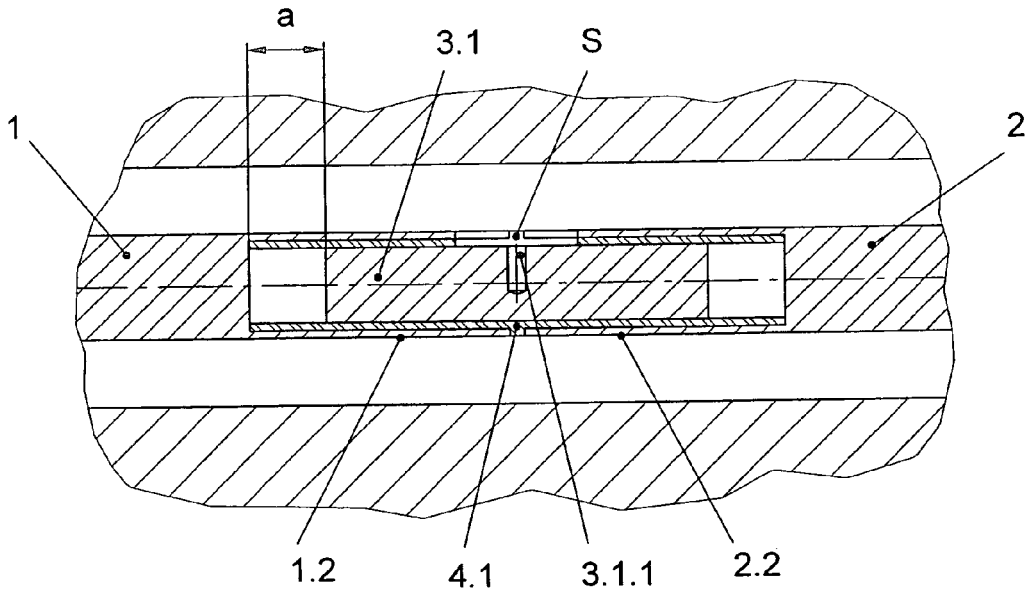
FIG. 6 illustrates a cross sectional view of an adjustable filter device according to another embodiment of the invention.

FIG. 6 shows another embodiment of an adjustable filter device, which is based on the same principle. The first inner conductor 1 includes a generally tubular or hollow cylindrical section 1.2 disposed at its end. Similarly, the second inner conductor 2 includes in tubular or hollow cylindrical section 2.2 disposed at its end. These sections 1.2, 2.2 enclose a common insulating sleeve 4.1. The filter further comprises a third inner conductor 3.1 that is axially displaceable along a path by a distance a. In the region of their mutually opposite facing edges, the sections 1.2 and 2.2 of the first and second inner conductors 1, 2 and the insulating sleeve 4.1 comprise a longitudinal slot S, through which a transversal bore 3.1.1 of the third inner conductor 3.1 is accessible in order to enable the axial displacement (i.e., adjustment) of the third inner conductor.

The method of adjustment is not particularly limited, and may be performed by a tool suitable for the purpose. For example, the adjustment can be performed by making the outer conductor (with a circular or polygonal internal cross section) divisible in the longitudinal direction or by equipping the outer conductor with a removable cover. Alternatively, the outer conductor can also be provided at the adjustment points with a sealable opening. Once the desired adjustment is made, the position of third inner conductor can be fixed with any desired HF-compatible means, e.g., by gluing or by PTFE rings. It has been observed that in series production, it is sufficient to perform the adjustment on a sample item of the filter and to transfer the set position of the inner conductors to the other filters of the same series without performing an electric adjustment again.

Figure 7:
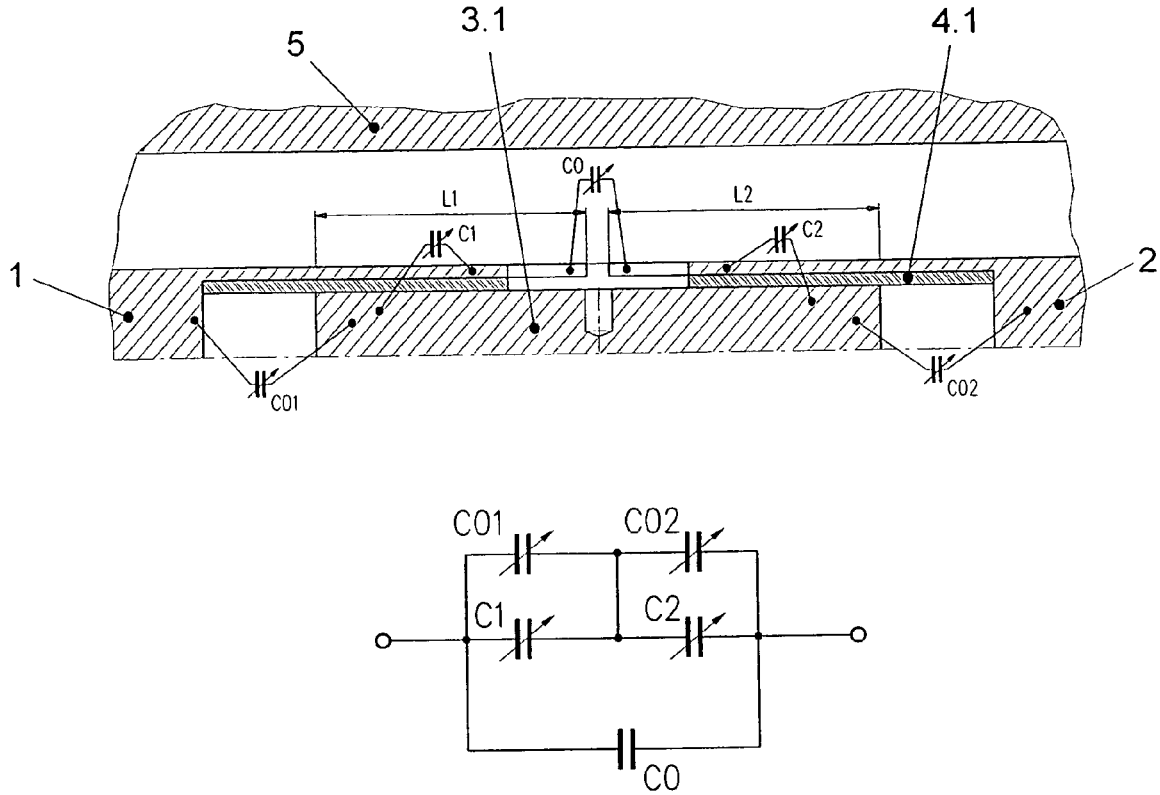
FIG. 7 illustrates a circuit block diagram of the filter device of FIG. 6, showing the series capacitances.

FIG. 7 is a circuit block diagram illustrating the respective series capacitances of the filter of FIG. 6. where as shown, $C_0$ is the capacitance between cylindrical section 1.2 (see FIG. 6.) of the first inner conductor 1 and the cylindrical section 2.2 (see FIG. 6) of the second inner conductor 2. $C_{01}$ is the capacitance between the first inner conductor 1 and the third inner conductor 3.1, (see FIG. 6) $C_{02}$ is the capacitance between the second inner conductor 2 and the third inner conductor 3.1. $C_1$ is the capacitance between the third inner conductor 3.1 and the cylindrical section 1.2 of the first inner conductor 1, and $C_2$ is the capacitance between the third inner conductor 3.1 and the cylindrical section 2.2 of the second inner conductor 2 across common insulating sleeve 4.1. In addition, similar to FIG. 4A, is the length of overlap between third inner conductor 3.1 and the first inner conductor 1 (specifically the cylindrical section 1.2 of the first inner conductor 1) and L2 is the length of overlap between the third inner conductor 3.1 and the second inner conductor 2 (specifically, the cylindrical section 2.2 of the second inner conductor 2). The value of the total series capacitance $C_{ges}$ between the first inner conductor 1 and the second inner conductor 2 is therefore:

$$C_{ges} = C_0 + \frac{(C_{01} + C_1)\cdot(C_{02} + C_2)}{C_{01} + C_{02} + C_1 + C_2} \tag{3}$$

While the invention has been described in detail and with reference to specific embodiments thereof, it will be apparent to one skilled in the art that various changes and modifications can be made therein without departing from the spirit and scope thereof. Accordingly, it is intended that the present invention covers the modifications and variations of this invention provided they come within the scope of the appended claims and their equivalents.

What is claimed:

1. An adjustable filter having at least one stage comprising:

an outer conductor;

a first inner conductor;

a second inner conductor capacitively coupled to the first inner conductor on the same axis; and a third inner conductor capacitively coupled to both the first inner conductor and the second inner conductor, wherein:

the third inner conductor is axially displaceable with respect to the first and second inner conductors;

the first inner conductor and the second inner conductor are enclosed in the region of their capacitive coupling by a sleeve comprising insulating material; and the third inner conductor comprises a metal sleeve which is axially displaceable on the insulating sleeve.

2. A filter according to claim 1, wherein the first inner conductor and the second inner conductor are axially displaceable relative to one another.

3. An adjustable filter having at least one stage comprising:

an outer conductor;

a first inner conductor;

a second inner conductor capacitively coupled to the first inner conductor on the same axis; and a third inner conductor capacitively coupled to both the first inner conductor and the second inner conductor, wherein the third inner conductor is axially displaceable with respect to the first and second inner conductors, and wherein the first inner conductor and the second inner conductor are configured to telescopically engage each other in the region of their capacitive coupling.

4. A filter according to claim 3, wherein the telescopically engaging regions of the first and second inner conductor are separated from each other by an insulating sleeve.

5. An adjustable filter having at least one stage comprising:

an outer conductor;

a first inner conductor;

a second inner conductor capacitively coupled to the first inner conductor on the same axis; and a third inner conductor capacitively coupled to both the first inner conductor and the second inner conductor, wherein:

the third inner conductor is axially displaceable with respect to the first and second inner conductors;

the first inner conductor and the second inner conductor comprise a generally a tubular structure in at least in the region of their capacitive coupling; and the first and second inner conductors enclose a common insulating sleeve in which the third inner conductor is axially displaceable.

* * * * *

UNITED STATES PATENT AND TRADEMARK OFFICE

CERTIFICATE OF CORRECTION

PATENT NO. : 7,348,869 B2
APPLICATION NO. : 11/346595
DATED : March 25, 2008
INVENTOR(S) : Friedrich Jakob It is certified that error appears in the above-identified patent and that said Letters Patent is hereby corrected as shown below:

In col. 3, line 42, the line should read: -- between the first inner conductor and 1 and the second inner conductor 3, -- (delete the period after the number 3 and replace with a comma -- , --)

In col. 4, line 35, the line should read: -- section 2.1 of the second inner conductor, across sleeve 6 -- (delete the first occurrence of the term "second" and replace with -- section --)

In col. 5, line 7, the line should read: -- conductor 3.1, Csub1 is the capacitance between the third inner conductor -- (delete the period after the number 3.1 and replace with a comma -- , --)

In col. 5, line 12, the line should read: -- 4.1. In addition, similar to FIG. 4A, L1 is the length of overlap -- (add the term -- L1 -- after the number 4A).

Signed and Sealed this

Seventeenth Day of June, 2008

JON W. DUDAS
*Director of the United States Patent and Trademark Office*